United States Patent [19]

King et al.

[11] Patent Number: 4,864,910

[45] Date of Patent: Sep. 12, 1989

[54] DOUBLE SWIVEL TOGGLE RELEASE

[75] Inventors: Guy L. King; William C. Schneider, both of Houston, Tex.

[73] Assignee: United States of America as represented by the Administrator, National Aeronautics and Space Administration, Washington, D.C.

[21] Appl. No.: 313,839

[22] Filed: Feb. 23, 1989

[51] Int. Cl.[4] ..... F41F 3/00; B64D 1/12

[52] U.S. Cl. ..... 89/1.14; 89/1.57; 102/378; 194/82.26; 194/82.29

[58] Field of Search ..... 294/82.26, 82.29, 82.32; 102/377, 378; 89/1.14, 1.57

[56] References Cited

U.S. PATENT DOCUMENTS

| | | | |
|---|---|---|---|
| 2,489,984 | 11/1949 | Shoemaker | 89/1.57 |
| 2,779,283 | 1/1957 | Baughman | 102/377 |
| 3,024,592 | 3/1962 | Leaman | 60/637 |
| 3,071,404 | 1/1963 | Van Hove | 89/1.1 |
| 3,084,597 | 4/1963 | Beyer | 89/1.14 |
| 3,116,663 | 1/1964 | Musgrave | 294/82.26 |
| 3,119,298 | 1/1964 | Brown | 85/1.14 |
| 3,200,706 | 8/1965 | Kinard | 89/1.57 |
| 3,445,133 | 5/1969 | Reischl | 294/82.32 |
| 3,477,333 | 11/1969 | Boyd et al. | 102/377 |
| 3,600,031 | 8/1971 | Coleman et al. | 294/82.32 |
| 3,830,186 | 8/1974 | Janssen et al. | 403/76 |
| 4,225,258 | 9/1980 | Thompson | 403/56 |
| 4,682,804 | 7/1987 | Palmer et al. | 294/82.26 |
| 4,692,127 | 9/1987 | Wagner | 403/56 |

*Primary Examiner*—David H. Brown

*Attorney, Agent, or Firm*—Russell E. Schlorff; John R. Manning; Edward K. Fein

[57] ABSTRACT

A pyrothechnic actuated structural release device which is mechanically two fault tolerant for release. The device comprises a fastener plate 11 and fastener body 12 each attachable to one of a pair of structures to be joined. The fastener plate 11 and the fastener body 12 are fastenable by a dual swivel toggle member 13. The toggle member is supported at one end on the fastener plate and mounted for universal pivotal movement thereon. Its other end is received in a central opening in the fastener body 12, and has a universally mounted retainer ring member 38. The toggle member 13 is restrained by three retractable latching pins symmetrically disposed in equiangular spacing about the axis of the toggle member 13 and positionable in latching engagement with the retainer ring member on the toggle member. Each pin is retractable by a pyrotechnic charge, the expanding gases of which are applied to a pressure receiving face on the latch pins to effect retraction from the ring member. While retraction of all three pins releases the ring member, the fastener is mechanically two fault tolerant since the failure of any single one or pair of the latch pins to retract results in an asymmetrical loading on the ring member and its dual povotal movement ensures a release.

4 Claims, 2 Drawing Sheets

DOUBLE SWIVEL TOGGLE RELEASE

ORIGIN OF THE INVENTION

The invention described herein was made by employees of the United States Government and may be manufactured and used by or for the Government of the United States of America for government purposes without the payment of any royalties thereon or therefor.

RELATED APPLICATION

U.S. patent application Ser. No. 154,712 filed Feb. 11, 1988 (MSC-21354-1) is a related application.

1. Field of the Invention

This invention relates generally to releasable fasteners and more particularly to an explosive actuated releasable fastener which ensures release even with the occurrence to two mechanical faults in the releasing mechanism.

For aerospace application, structural release fasteners of release of devices in space must be extremely reliable in operation. It is desirable that the release fastener be able to remain connected under extreme loading conditions and be adaptable to a variety of configuration load conditions and yet be relatively light weight and compact in size. It may also be important upon release that the device transmit a very low impulse into adjacent structure and that ejected pieces or debris be minimized.

2. Background Art

There have been many designs for releasable fasteners including explosively releasable fasteners. Most of these are mechanically zero fault tolerant since failure of a single component renders them inoperative. As an example, redundant pin pullers for release of a toggle have been employed in a releasable fastener. Clamps, such as a Marmon clamp assembly, have also been used which utilize two bolts for joining structures together wherein each bolt is severable by an independent pair of cutters. In such designs, however, failure of multiple components will not effect a release.

Releasable fasteners which employ a single explosive device for retracting or shearing a single latching member are shown in U.S. Pat. Nos. 3,024,592; 3,084,597; and 3,119,298. Other releasable fasteners, wherein a single explosive device is used to retract a plurality of latching members are shown in U.S. Pat. Nos. 2,489,984 and 4,071,404. In U.S. Pat. No. 2,779,283, a connector is shown for securing an aerial vehicle to a booster rocket wherein the rocket gases cause the retraction of a pair of latching pawls in effecting a release. None of these devices, however, are mechanically two fault tolerant for effecting release.

Other patent references of interest are as follows:

U.S. Pat. No. 3,830,186 issued Aug. 20, 1974 which shows a spherical ball coupling on a tug boat where a pair of holding latches engage an annular coupling shoulder which is rotatable about an axis of rotation.

U.S. Pat. No. 4,255,258 issued Sept. 30, 1980 which shows a construction for a pair of ball connectors which are received in distal ends of a split socket connector.

U.S. Pat. No. 4,692,127 issued Sept. 8, 1987 which shows a pair of spherically shaped ends for a universal connector to provide a force transmitting connection between axis which are not co-linear.

U.S. Pat. No. 4,682,804 issued July 28, 1987 which relates to a dual release mechanism for spacecraft uses where a pair of locking surfaces engage opposite sides of a pivoted pawl tab. Should only one of the locking surfaces be released, the panel tab pivots to release the other surface.

In the related application Ser. No. 154,712 (MSC-21354-1) a two fault tolerant release mechanism is disclosed where a toggle with a spherical surface is held in a fixed position relative to a support axis by equiangularly spaced pin members about the support axis. The pin members are at an angle relative to the support axis in a locked position and have engaging surfaces with similarly inclined locking surfaces on the toggle. If at least one of the pins is actuated, a loading force is applied by the remaining pins in contact with the toggle to pivot the toggle to a location where the toggle escapes from the restraint. This system which utilizes pins on an angle has the disadvantage that there is a pre-loading on the pins which induces high frictional forces making the pins harder to retract and requiring greater retraction pressures for operation. Additionally, machine manufacturing tolerances can become critical to assure that the bottom end of the toggle can be released and the mechanism requires packaging space for the angled pins. But most importantly, the single swivel system can hang up and not release properly.

SUMMARY OF THE INVENTION

This invention is particularly suited for releasably connecting structures to be used in the space environment or in aerospace applications where reliability is paramount. The releasable fastener comprises a fastener plate member and a fastener body member, each of which is separately attachable to a pair of structures to be releasably joined. The fastener plate and the fastener body members are adapted to be coupled to one another by a double swivel toggle member. One ball end of the toggle member is supported in a spherically shaped bearing surface in a socket carried by the fastener plate member and is adapted for universal pivotal movement. The other ball end of the toggle member supports a spherically shaped bearing surface in a ring member. Three latching pins are disposed in a plane transverse to the axis of the toggle member. The three pins are slidably disposed in pin receiving bores in the fastener body and are arranged in a symmetrical equiangular spacing about the axis of the toggle member. A center bore of the fastener body surrounds the toggle member and each pin has an end portion extending into the center bore to engage a shoulder provided on the ring member. The engagement of the ring member by the ends of the pins prevents the toggle member from axial movement. Each pin is individually retractable. While pyrotechnic means are preferable for pin actuation, other means such as pneumatic or hydraulic systems, etc., could also be employed to actuate the pins.

Normally the pins are simultaneously retracted, releasing the ring member and permitting the structures connected by the toggle member to separate. The successful retraction of any single pin or a combination of any two of the pins results in an asymmetrical loading on the ring member and on the toggle member whereby both the ring member and the other ball end of the toggle member are free to pivot. With only a single swivel, hang up can occur due to the friction between the toggle and retractor pin, however, this cannot happen with a dual swivel since pivotal movement of the ring member on the ball end of the toggle member frees the ring member from the inoperative latching pin and effects release of the toggle member.

Accordingly, the releasable fastener of this invention is two fault tolerant because the dual swivel will insure release even if one or two of the latching pins fail to retract.

Other advantages of this invention will be apparent from the description which follow, in conjunction with the accompanying drawings and claims.

DETAILED DESCRIPTION OF THE PREFERRED EMBODIMENT

Figure 1:
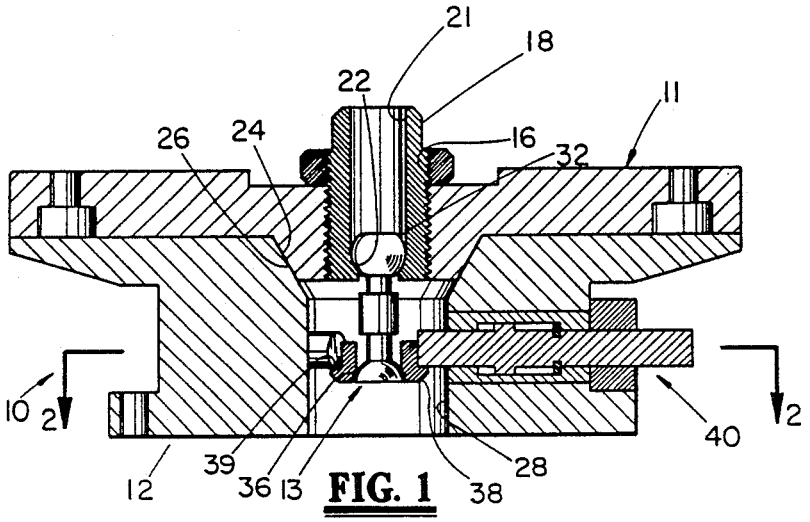
FIG. 1 is a side view in cross-section of a fastener as it appears when assembled in fastening condition.
Figure 2:
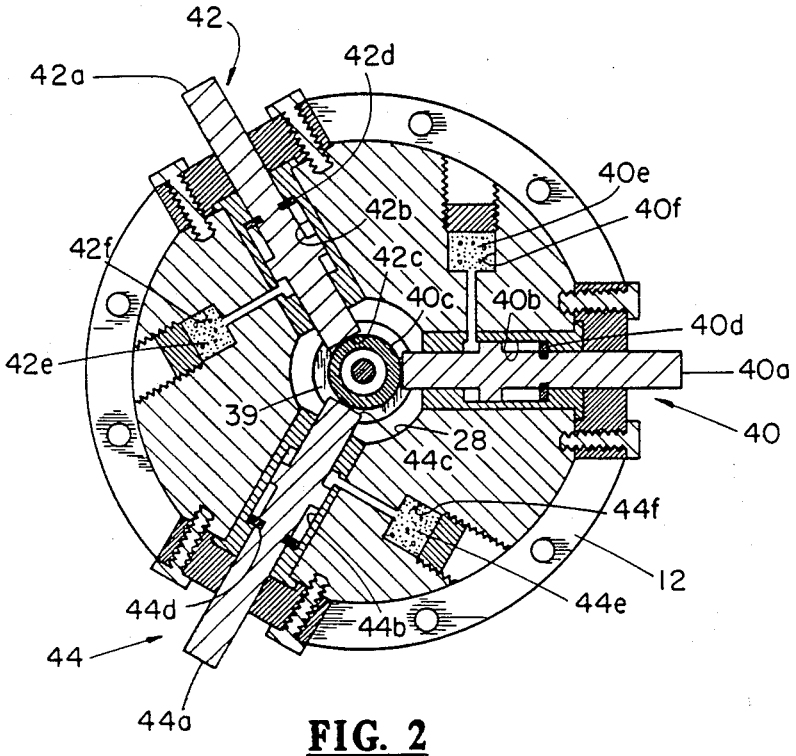
FIG. 2 is a view in cross-section taken along line 2—2 of FIG. 1.
Figure 3:
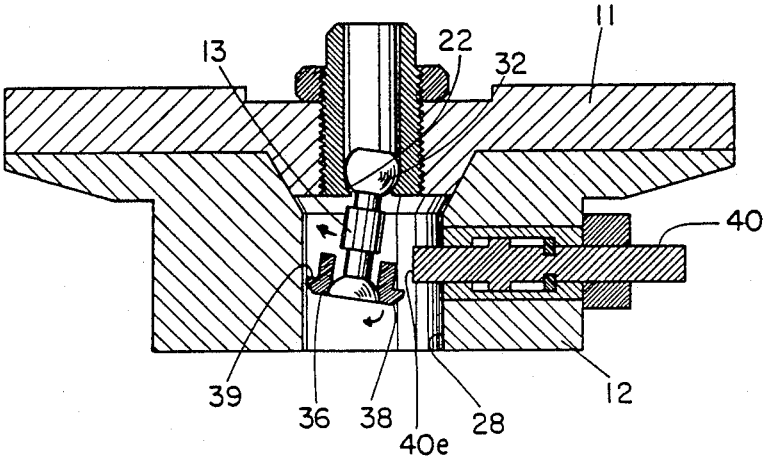
FIG. 3 is a view similar to FIG. 1 but showing the release function of the toggle member when one pyrotechnic charge has failed.

Referring more particularly to the drawings, there is shown in FIG. 1 and FIG. 2, a releasable fastener 10 which represents a preferred embodiment of the invention. The fastener 10 connects a fastener plate member 11 and a fastener body member 12 by a means of a releasable toggle member 13. The fastener plate member 11 and the fastener body member 12 may be provided with bolt holes for accommodating rigid connection to other structures so that the connected structures are releasably fastened by the fastener 10. The members may, of course, be secured to the structures by welding or other suitable means.

As can be seen in FIG. 1, the fastener plate member 11 is provided with a central threaded axial bore 16 for accommodating an externally threaded annular bolt 18. The bolt 18 is provided with a central axial bore 21. At the lower end of the bore 21 is an internal spherically shaped seat 22.

The fastener plate member 11 is also provided with a lower frusto conical centering projection 24 which is received in a frusto conical counterbore 26 in the body member 12 so that facing surfaces on the body member and the plate member are in contact with one another. Normally, external forces are present which tend to pull the structures apart.

The body member 12 has a central bore 28 and the toggle member 13 is centrally mounted in the bore 28 by a top swivel ball portion 32 which is universally and swivelly mounted in the seat 22.

The toggle member 13 has a stem section and a lower enlarged spherically shaped swivel ball section 36. The swivel ball section 36 faces upwardly and receives an annular retainer ring member 38. The ring member 38 has a complimentary spherical support surface for universal pivotal movement of the ring member 38 on the lower ball section 36. The ring member has an upwardly facing annular latching surface 39 for purposes hereinafter described.

Three pyrotechnic thruster means 40, 42, 44 are disposed equiangularly in a plane transverse to the central axis of the bore 28. The thruster means 40, 42, 44 respectively include thruster pins **40*a*, 42*a*, 44*a* which are equiangularly spaced from one another (120° apart) about the central axis. Each thruster pin is respectively slidably mounted in a pin bore 40*b*, 42*b*, 44*b* for movement between a first position where the respective inner ends 40*c*, 42*c*, 44*c* of the thruster pins overlie the annular latching surface 39 of the retainer ring 38 and a second position where the respective inner ends 40*c*, 42*c*, 44*c* of the thruster pins are displaced from the latching surface 39. In the first position of the thruster pins, a suitable release means such as a shear pin or shear ring 40*d*, 42*d*, 44*d* releasably retain the pin in position. Each pin has a piston positioned in a chamber whereby electrical detonation of an explosive charge 40*e*, 42*e*, 44*e*** generates combustion gases to the piston to shear the shear ring and displace the pin from the first position to the second position. Pyrotechnic operation of pins as well as hydraulic or other actuation systems are well known.

A charge device **40*e*, 42*e*, 44*e* is preferably a conventional pyrotechnic initiator or explosive squib of the type for installation into a charge receiving chamber such as the bore 40*f*, 42*f*, 44*f***. Each charge device is provided with external electrical leads to a cable for connecting in an electrical firing circuit to a source of electrical energy (not shown). In conventional fashion, the circuit may be selectively activated to cause the explosive charge devices to detonate selectively.

Firing circuitry is provided whereby the three charge devices **40*e*, 42*e*, 44*e* are simultaneously detonated for simultaneous retraction of the three latching pins 40*a*, 42*a*, 44*a***. While in most applications simultaneous detonation and retraction is to be preferred, the charge devices could be individually detonated in a selected sequence and firing circuits provided accordingly.

If all three explosive charges are detonated simultaneously and there is successful simultaneous retraction of the latch pins **40*a*, 42*a*, 44*a*, the constraint applied by the latch pins on the retainer ring member 38 will be simultaneously removed and the toggle member 13 will move in a substantially axial direction as a result of the preload or external forces; however, if there is a failure of any one or two of the latching pins 40*a*, 42*a*, 44*a* to retract, the loading force applied to ring member 38 on toggle member 13 by latching pin 40*a* or pair of pins 40*a* and 42*a* still in contact therewith, will cause ring member 38 to pivot on its universal mounting 36 then the top ball 32 of toggle 13 will swivel in its seat in the fastener plate 11 as shown, whereby the ring member 38 escapes from constraining contact with the non-retracted latch pins. Release of toggle member 13 allows separation of the fastener plate 11 from the fastener body 12 by the external forces tending to separate the two structures. This pivotal movement of ring member 38 and toggle 13 to escape the latch pins 40*a*, 42*a*, 44a will always occur because the contact points of any one or two of the latching pins on the ring member will always be on one side of the axis of toggle member 13**. Such asymmetric loading to cause pivotal movement of the toggle member and the ring member will also occur if the pyrotechnic changes are fired in sequence and the latch pins retracted in sequence.

The double swivel toggle represents a statically determinant structural system since there are three pin reactions and the bottom swivel cannot exert a bending moment. For this arrangement, each of the three pin forces will be equal at all times and the net toggle force will be equal to three times the force exerted by only one pin. So, if the pins are in the non-retracted configuration and the toggle is under preload, then each of the pin forces are equal to one third of the preload force. The tolerance on the pin holes as well as their location tolerance does not affect this equality of pin forces for the double swivel system. Thus the successful deployment of the double swivel system is relatively insensitive to tolerance buildup. It is important to note, that the pyrotechnic pin requires no taper (or slope) at the toggle/pin interface. This eliminates any force tending to inadvertently push back the pin. Likewise, if only one of the pins is retracted (i.e. it's pin force is equal to zero) then the other two pin forces will vanish also and the net force on the toggle is, necessarily, equal to zero thus allowing clean separation.

Figure 4:
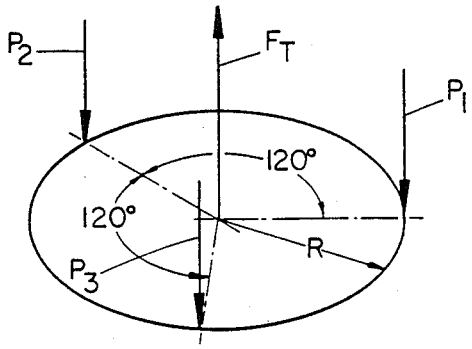
FIG. 4 is a force diagram of the toggle member.

As shown in FIG. 4, with a free body diagram, an upward force $F_T$ and is equal and is opposite to the sum of the downward pin forces $P_1$, $P_2$ and $P_3$ or $$F_T = P_1 + P_2 + P_3 \quad (1)$$

so that $$F_T = 3P_1 = 3P_2 = 3P_3$$

Thus, if any pin force becomes zero, the upward force $F_T$ becomes zero.

In FIG. 4, given the radius R the sum of the moments about $P_1$ is $$M = -P_2R \sin 60° + P_3R \sin 60° = 0$$

so that $P_2 = P_3$.

The sum of the moments about $P_3$ is $$M = -P_2R \sin 60° + P_1R \sin 60° = 0$$

so that $P_1 = P_2$.

With $P_1$ equal to $P_2$ equal to $P_3$, all moments vanish at the retainer ring.

In this arrangement, even if the pins are different in diameter (due to tolerances) the forces remain equal.

The double swivel can never become "locked up" since a balance, between the forces and moments, cannot exist, with at least one pin retracted, unless the total toggle force is equal to zero. Also, since the bottom swivel insures equality of pin forces, the tendency for one pin to "drag" the double swivel to one side is minimized. Furthermore, the pin does not require a slope (angle) at the toggle/pin interface to retract freely without "lockup" and thus there is no force trying to push the pins towards a retracted position. The preload is not limited by the pin bending. Successful deployment of the double swivel is not dependent on machine tolerances and can be packaged, in a small space.

It is to be appreciated, therefore, that changes may be made by those skilled in the art without departing from the spirit of the invention.

What is claimed is:

1. A double swivel releasable fastener for releasably joining separable structures which normally tend to separate from one another, said fastener comprising:

a fastener plate member and a fastener body member, each of which is separately attachable to a different one of two structures to be releasably joined;

a double swivel toggle member for releasably fastening the fastener plate member to the fastener body member;

said toggle member having a body portion which is elongated along a central axis and is attached at one end to the fastener plate member where the toggle member at said one end has a ball surface portion located symmetrically about a cylindrical body portion and said central axis, said ball surface portion being mounted for universal pivotal movement in a ball socket opening located in said fastener plate member;

said fastener body member being in a facing relationship to said fastener plate member and having a body member opening in the face of the fastener body member disposed towards the fastener plate member, said body member opening being sized to receive said toggle member and allow limited pivotal movement of the toggle member about said one end;

three retractable latching pins slidably mounted in latch pin receiving bores provided on the fastener body member in a symmetrical equiangular spacing about the other end of said toggle member, said latching pins being located on a plane transverse to said central axis of said toggle member when said plate member and said body member are releasably joined;

said other end of said toggle member having a spherical contact surface portion symmetrically located about said body portion and said central axis of the toggle member;

an annular ring member having a spherically shaped opening rotatively mounted on said spherical contact surface portion for relative universal movement relative to said toggle member, said ring member having an outer annular latching surface normally located transverse to said central axis of said toggle member;

each latching pin being cylindrically shaped with an end portion positionable in contact with said annular latching surface on said annular ring member for releasably retaining said latching surface in a transverse position on the toggle member whereby said toggle member is engaged and restrained by the latching pins at engagement points symmetrical disposed with respect to said central axis; and means for retracting said latching pins from latching engagement with the ring member on said toggle member whereby retraction at least of one of the latching pins results in release of the ring member, the toggle member and said fastener plate member from said fastener body member by virtue of pivotal movement of the ring member with respect to the toggle member and by virtue of pivotal movement of the toggle member with respect to said fastener plate member.

2. A releasable fastener as described in claim 1 wherein said fastener plate member is provided with a threaded opening extending through said plate member and said ball socket opening is located in an annular bolt threaded into said threaded opening whereby an axial pre-load force may be applied to the toggle member when said plate member and said body member are releasably joined.

3. A releasable fastener as described in claim 1 wherein each of said latching pins is provided with an annular flange intermediate its ends, and said retracting means includes detonable charge devices mounted in individual charge receiving bores in the fastener body, each said charge receiving bore being in communication with a different one of said latch pin receiving bores whereby explosive gases resulting from detonation of an explosive charge is communicated to a latch pin receiving bore in communication therewith and applied to a pressure receiving face on a latch pin to effect retraction of a latch pin from the ring member.

4. A dual swivel, fault tolerant releasable fastener device for releasably joining separable structures which normally tend to separate, said fastener device comprising:

a fastener plate and a fastener body, each of which is separately attachable to a different one of two structures to be joined;

an elongated toggle member for releasably fastening the fastener plate to the fastener body;

said toggle member being elongated along a central axis and being attached at one end to said fastener plate which includes a ball surface portion symmetrically located about a cylindrical body portion and said central axis of said toggle member, said ball surface portion being mounted for universal pivotal movement about said one end in a ball socket opening in said fastener plate;

said fastener body being in a facing relationship to said fastener plate and having an opening in the face of the fastener body disposed towards the fastener plate, said opening being sized to receive the other end of said toggle member and allow limited pivotal movement of the toggle member about said one end;

three retractable latching pins slidably mounted in latch pin receiving bores provided on the fastener body in symmetrical equiangular spacing about said other toggle end, said latching pins being located on a plane transverse to said central axis;

said other end of the toggle member pivotally supporting an annular retainer ring with a universal mounting about the central axis of the toggle member, each latching pin being positionable with an end portion thereof in contact with the retainer ring in a plane transverse to the central axis of the toggle member and in latching engagement with the retainer ring whereby said toggle member is engaged and restrained by the latching pins at engagement points symmetrical with respect to the central axis of said toggle member; and means for retracting each of said latching pins from latching engagement with the retainer ring whereby retraction of at least one of the latching pins results in release of the toggle member and said fastener plate from said fastener body by virtue of pivotal movement of the ring member with respect to the toggle member and by virtue of pivotal movement of the toggle member with respect to said fastener plate.

* * * * *